US011120962B2

(12) United States Patent
Schmidt et al.

(10) Patent No.: US 11,120,962 B2
(45) Date of Patent: Sep. 14, 2021

(54) LOAD TRANSFER SWITCH FOR AN ON-LOAD TAP CHANGER AND CONTINUOUS MAIN SWITCH AND DISCONNECTING SWITCH FOR SAME

(71) Applicant: Maschinenfabrik Reinhausen GmbH, Regensburg (DE)

(72) Inventors: Eduard Schmidt, Bad Abbach (DE); Silke Wrede, Zeitlarn (DE); Gregor Wilhelm, Regensburg (DE); Christian Hammer, Regensburg (DE)

(73) Assignee: MASCHINENFABRIK REINHAUSEN GMBH, Regensburg (DE)

( * ) Notice: Subject to any disclaimer, the term of this patent is extended or adjusted under 35 U.S.C. 154(b) by 872 days.

(21) Appl. No.: 15/755,581

(22) PCT Filed: Aug. 28, 2015

(86) PCT No.: PCT/EP2015/069752
§ 371 (c)(1),
(2) Date: Feb. 27, 2018

(87) PCT Pub. No.: WO2017/036496
PCT Pub. Date: Mar. 9, 2017

(65) Prior Publication Data

US 2020/0168420 A1 May 28, 2020

(51) Int. Cl.
*H01H 67/02* (2006.01)
*H01H 50/54* (2006.01)
(Continued)

(52) U.S. Cl.
CPC ..... *H01H 50/54* (2013.01); *H01F 29/04* (2013.01); *H01H 9/0016* (2013.01); *H01H 9/0027* (2013.01)

(58) Field of Classification Search
CPC .... H01H 50/54; H01H 9/0016; H01H 9/0027; H01H 9/00; H01F 29/04
(Continued)

(56) References Cited

U.S. PATENT DOCUMENTS 2,231,627 A * 2/1941 Jansen ..... H01H 9/0016 200/9
2,680,790 A * 6/1954 Jansen ..... H01H 9/0027 200/6 R
(Continued)

FOREIGN PATENT DOCUMENTS

CH 467510 A 1/1969
CN 101383223 A 3/2009
(Continued)

*Primary Examiner* — Shawki S Ismail
*Assistant Examiner* — Lisa N Homza
(74) *Attorney, Agent, or Firm* — Leydig, Voit & Mayer, Ltd.

(57) ABSTRACT

A switch includes a diverter contact; a primary fixed contact; and a secondary fixed contact. The switch additionally includes a primary movable contact configured to be pivoted, relative to the diverter contact and the primary fixed contact, about a pivot axis between a first end position and a second end position. In the first end position, the primary movable contact bears by a first contact point against the diverter contact and by a second contact point against the primary fixed contact. The switch further includes a secondary movable contact configured to be pivoted, relative to the diverter contact and the secondary fixed contact, about the pivot axis between a first end position and a second end position. In the first end position the secondary movable contact bears by a third contact point against the diverter contact and by a fourth contact point against the secondary fixed contact.

18 Claims, 4 Drawing Sheets

(51) Int. Cl.
*H01F 29/04* (2006.01)
*H01H 9/00* (2006.01)

(58) Field of Classification Search
USPC ..... 335/132
See application file for complete search history.

(56) References Cited

U.S. PATENT DOCUMENTS 3,174,097 A 3/1965 Bleibtreu
3,250,865 A * 5/1966 Bleibtreu ..... H01H 5/06 200/11 TC
3,258,546 A * 6/1966 Bleibtreu ..... H01H 3/46 200/6 BA
3,632,908 A 1/1972 Bleibtreu et al.
3,889,219 A * 6/1975 Larner ..... F16K 35/16 335/234
4,609,899 A * 9/1986 Koehler ..... H01H 51/2209 335/230
4,631,507 A * 12/1986 Guery ..... H01H 71/40 335/27
5,523,535 A * 6/1996 Larsson ..... H01H 9/0016 200/11 TC
6,008,456 A * 12/1999 Pillmeier ..... H01H 9/0027 200/11 TC
8,927,885 B2 * 1/2015 Hoepfl ..... H01H 1/56 200/11 TC
9,165,724 B2 * 10/2015 Shen ..... H01H 1/06
2003/0137373 A1 * 7/2003 Grumel ..... H01H 71/70 335/68
2005/0205394 A1 * 9/2005 Kloth ..... H01H 9/0016 200/6 R
2007/0229204 A1 * 10/2007 Ogikubo ..... H02N 1/006 335/220
2008/0185272 A1 * 8/2008 Otani ..... G06F 3/0362 200/318
2010/0264851 A1 * 10/2010 Dellian ..... H01H 23/003 315/312
2013/0112541 A1 * 5/2013 Albrecht ..... H01H 9/0016 200/564
2015/0179362 A1 6/2015 Hammer et al.
2016/0155580 A1 * 6/2016 Zwirglmaier ..... H01H 9/0033 200/11 TC
2016/0181025 A1 * 6/2016 Hoepfl ..... H01H 9/0038 200/11 TC

FOREIGN PATENT DOCUMENTS

DE 1930719 B1 10/1970
GB 2077503 A 12/1981
JP S60124809 A 7/1985
JP 2010258266 A 11/2010
JP 2013247170 A 12/2013

* cited by examiner

LOAD TRANSFER SWITCH FOR AN ON-LOAD TAP CHANGER AND CONTINUOUS MAIN SWITCH AND DISCONNECTING SWITCH FOR SAME

CROSS-REFERENCE TO PRIOR APPLICATIONS

This application is a U.S. National Stage Application under 35 U.S.C. § 371 of International Application No. PCT/EP2015/069752 filed on Aug. 28, 2015. The International Application was published in German on Mar. 9, 2017, as WO 2017/036496 A1 under PCT Article 21(2).

FIELD

The invention relates to a load changeover switch for an on-load tap changer of a setting transformer and to a continuous main switch and an isolating switch for a load changeover switch of an on-load tap changer as well as generally to a switch for a switching device.

BACKGROUND

CH 467 510 A describes a load changeover switch for an on-load tap changer. This known load changeover switch comprises, for each phase to be switched, a diverter contact, a primary fixed contact, a secondary fixed contact, a primary moved contact and a secondary moved contact. The primary fixed contact is electrically conductively connected with a first movable selector contact or primary selector contact of the on-load tap changer. The secondary fixed contact is electrically conductively connected with a second movable selector contact or secondary selector contact of the on-load tap changer. Each primary moved contact is mounted to be so linearly displaceable at right angles to a central switching shaft of the on-load tap changer that it can adopt a first end position in which it bears against the diverter contact and the respective primary fixed contact and a second end position in which it is separated from these contacts. Each secondary moved contact is mounted to be so linearly displaceable at right angles to the switching shaft that it can adopt a first end position in which it bears against the diverter contact and the respective secondary fixed contact and a second end position in which it is separated from these contacts. This known load changeover switch additionally comprises a double lever, a stationary axle, a cam roller and, for each moved contact, a stationary pin and a movable axle. The double lever is rotatably mounted at the centre thereof on the stationary axle and carries at each free end one of the movable axles and, at one side, the cam roller, which is arranged between one of the movable axles and the stationary axle. The cam roller runs in a cam of a cam disc of the on-load tap changer. The cam disc is seated on a switching shaft of the on-load tap changer to be secure against relative rotation. Each moved contact is rotatably mounted on the respective movable axle and has a straight groove in which the respective pin is seated. Consequently, a rotational movement of the switching shaft is converted into a rectilinear movement of the moved contacts.

SUMMARY

In an embodiment, the present invention provides a switch. The switch includes a diverter contact; a primary fixed contact; and a secondary fixed contact. The switch additionally includes a primary movable contact configured to be pivoted, relative to the diverter contact and the primary fixed contact, about a pivot axis between a first end position and a second end position. In the first end position, the primary movable contact bears by a first contact point against the diverter contact and by a second contact point against the primary fixed contact. In the second end position the primary movable contact is separated from the diverter contact and the primary fixed contact. The switch further includes a secondary movable contact configured to be pivoted, relative to the diverter contact and the secondary fixed contact, about the pivot axis between a first end position and a second end position. In the first end position the secondary movable contact bears by a third contact point against the diverter contact and by a fourth contact point against the secondary fixed contact. In the second end position the secondary movable contact is separated from the diverter contact and the secondary fixed contact.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
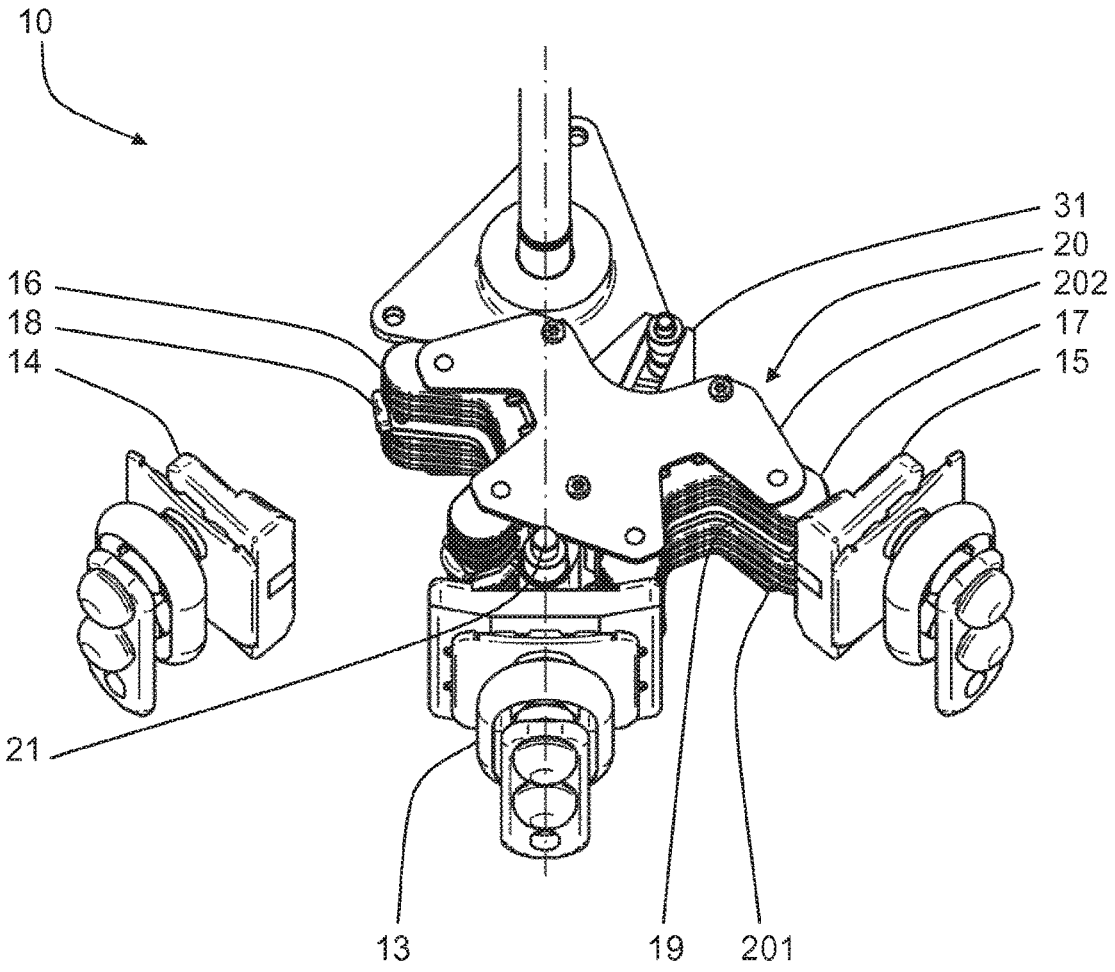
FIG. 1 shows a perspective view of a continuous main switch for a load changeover switch according to an embodiment of the invention.

Embodiments according to a first aspect of the invention provide a switch for or in a switching device, comprising a diverter contact; a primary fixed contact; a secondary fixed contact; a primary moved contact which is so pivotable or mounted to be pivotable relative to the diverter contact and the primary fixed contact about a pivot axis that it can adopt a first end position in which it bears by a first contacting point or resting point or contact point against the diverter contact and by a second contacting point or resting point or contact point against the primary fixed contact and a second end position in which it is separated from these contacts; and a secondary moved contact which is so pivotable or mounted to be pivotable relative to the diverter contact and the secondary fixed contact about the pivot axis that it can adopt a first end position in which it bears by a third contact point against the diverter contact and by a fourth contact point against the secondary fixed contact and a second end position in which it is separated from these contacts.

Since, in the case of the proposed switch, the moved contacts are pivotable, at least some of the transmission components required in accordance with the teaching of CH 467 510 A for conversion of the rotational movement of the switching shaft into the rectilinear movement of the moved contacts can be eliminated. The proposed switch can thus be of very simple construction.

As used herein, an expression of the kind "A is connected with B" can correspond with an expression of the kind "A is joined with B"; an expression of the kind "A is connected with B" can embrace the meanings "A is electrically conductively directly connected with B" and "A is electrically conductively indirectly connected with B, thus by way of C"; and an expression of the kind "A is attached to B" can have the meaning "A is electrically conductively directly connected with B".

The diverter contact is preferably joined, in particular attached, to ground or to an earth potential or to a star point or to a corner point of a delta connection or to a diverter of the switching device. The diverter can in turn be joined, in particular attached, to, for example, ground or earth potential or a star point or a corner point of a delta connection.

The proposed switch can be constructed in any desired mode and manner according to requirements, for example as a continuous main switch or as an isolating switch for or in a load changeover switch of an on-load tap changer.

A continuous main switch is usually connected in a load changeover switch in parallel with at least one vacuum interrupter of the load changeover switch so as to increase the current carrying capacity of the load changeover switch. An isolating switch is usually connected in a load changeover switch in series with at least one vacuum interrupter of the load changeover switch so as to increase the voltage strength of the load changeover switch.

The diverter contact, the fixed contacts and the moved contacts are preferably mounted on a frame of the switching device. The frame can be unitary or comprise at least two sub-frames. If the switch is a continuous main switch or an isolating switch for or in a load changeover switch then the frame of the load changeover switch preferably comprises a contact cylinder—which is constructed as, in particular, an oil vessel—as a first sub-frame and a framework of a load changeover switch insert as a second sub-frame, which is coupled to the first sub-frame. The diverter contact and the fixed contacts are preferably mounted on, in particular secured to, the first sub-frame and the moved contacts are mounted on, in particular secured to, the second sub-frame. The framework is usually inserted from above into the contact cylinder and secured thereto in an upper edge region.

For preference, the primary fixed contact is joined, in particular attached, to a primary main line of the switching device and the secondary fixed contact to a secondary main line of the switching device. Each main line in turn can be joined, in particular attached, to, for example, a mains line, which is associated with a phase of an alternating current mains, or to a primary side or secondary side of a transformer or to a star point or to a corner point of a delta connection.

According to one or more embodiments of the invention, a first counterpoint at which the first contact point bears against the diverter contact is arranged at a spacing from a second counterpoint at which the third contact point bears against the diverter contact; and the pivot axis is arranged symmetrically between these counterpoints. According to one or more embodiments of the invention, the diverter contact is monolithic; the primary fixed contact is monolithic and, in particular, arranged to be rigid or immovable or stationary relative to the diverter contact; the secondary fixed contact is monolithic and, in particular, arranged to be rigid or immovable or stationary relative to the diverter contact; the primary moved contact is monolithic; and the secondary moved contact is monolithic.

As used herein, the term "monolithic" can have the meaning "unitary" or "consisting of one part or piece".

If in that regard, for example, the diverter contact is attached to a diverter line of the switching device, the primary fixed contact to a primary main line and the secondary fixed contact to a secondary main line of the switching device, then a particularly low-loss current path can be achieved.

According to one or more embodiments of the invention, in the first end position of the primary moved contact the first and second contact points lie on a first connecting straight line; and the first connecting straight line is non-parallel or at right angles or skewed with respect to the pivot axis.

As used herein, an expression of the kind "A is at right angles to B" can embrace the meanings "A intersects B at an angle of 90° " and "A is skewed with respect to B and the normal planes A and B are at right angles".

If, for example, the pivot axis extends vertically then the first connecting straight line can preferably extend horizontally and intersect the pivot axis or run past it. However, it is also possible for the first connecting straight line to be parallel to the pivot axis.

According to one or more embodiments of the invention, in the first end position the first and second contact points lie on a first connecting straight line and delimit a first connecting path; and the first connecting straight line and the pivot axis intersect and the intersection point thereof lies outside or within the first connecting path, or the first connecting straight line and the pivot axis are skewed and the dropped perpendicular foot of the first connecting straight line lies outside or within the first connecting path.

The proposed switch can be constructed in any desired mode and manner according to requirements, for example as a continuous main switch for or in a load changeover switch of an on-load tap changer or as an isolating switch for or in a load changeover switch of an on-load tap changer and/or comprise, for example, at least one additional diverter contact and/or at least one additional primary fixed contact and/or at least one additional primary moved contact and/or at least one additional secondary fixed contact and/or at least one additional secondary moved contact.

According to one or more embodiments of the invention, in the first end position of the secondary moved contact the third and the fourth contact points lie on a second connecting straight line; and the second connecting straight line is non-parallel or at right angles or skewed with respect to the pivot axis.

If, for example, the pivot axis extends vertically, then the second connecting straight line can preferably extend horizontally and intersect the pivot axis or run past it. However, it is also possible for the second connecting straight line to be parallel to the pivot axis.

According to one or more embodiments of the invention, in the first end position the third and the fourth contact points lie on a second connecting straight line and delimit a second connecting path; and the second connecting straight line and the pivot axis intersect and the intersection point thereof lies outside or within the second connecting path, or the second connecting straight line and the pivot axis are skewed and the dropped perpendicular foot of the second connecting straight line lies outside or within the second connecting path.

According to one or more embodiments of the invention, the diverter contact and the pivot axis are arranged symmetrically between the fixed contacts.

According to one or more embodiments of the invention, the proposed switch comprises at least one additional primary moved contact which is mounted to be so pivotable relative to the diverter contact and the primary fixed contact about the pivot axis that it can adopt a first end position in which it bears against the diverter contact and the primary fixed contact and a second end position in which it is separated from these contacts; and/or at least one additional secondary moved contact which is so mounted to be pivotable relative to the diverter contact and the secondary fixed contact about the pivot axis that it can adopt a first end position in which it bears against the diverter contact and the secondary fixed contact and a second end position in which it is separated from these contacts.

By way of the additional moved contacts the current carrying capacity or current loadability of the switch can be increased in accordance with requirements in steps in the manner of a modular system or module. The moved contacts are preferably constructionally identical.

According to one or more embodiments of the invention, the moved contacts are electrically conductively connected together. However, it is also possible for the moved contacts to be electrically separate from one another.

According to one or more embodiments of the invention, the proposed switch comprises at least one primary arcing contact which is mounted to be so pivotable relative to the diverter contact and the primary fixed contact about the pivot axis that it can adopt a first end position in which it bears by a fifth contacting point or resting point or contact point against the diverter contact and by a sixth contacting point or resting point or contact point against the primary fixed contact and a second end position in which it is separated from these contacts; wherein the primary moved contacts and the primary arcing contacts can be so pivoted in common that at least one of the primary arcing contacts adopts the first end position before the primary moved contacts and leaves after the primary moved contacts.

At least in a contact region containing or surrounding the fifth contact point and/or in a contact region containing or surrounding the sixth contact point the primary arcing contact, which is also termed primary sacrificial contact, is preferably more erosion-resistant and/or arc-resistant than in its remaining region and/or than the corresponding contact regions of the primary moved contacts. This is achieved, for example, in that it consists of a material which is, for example, a WCu alloy and which has a higher melting point by comparison with the material of the primary moved contacts, this being, for example, copper. For preference it consists of this material only in each contact region and in its remaining region consists of the material of the primary moved contacts.

The primary arcing contact is preferably monolithic. If it consists of this material with higher melting point only in each contact region than it is monolithic in each instance in its remaining region and in each contact region, and each contact region is formed by a small block of this material, which, for example, is soldered or screw-connected on the remaining region.

According to one or more embodiments of the invention, exactly one primary arcing contact and at least two primary moved contacts are present; and the primary moved contacts and the primary arcing contact are so arranged in stacked manner that the number of primary moved contacts on one side of the primary arcing contact is higher by at most one than the number of primary moved contacts on the opposite side of the primary arcing contact. The primary arcing contact thus lies at or as close as possible to the centre of the stack of primary moved contacts.

According to one or more embodiments of the invention, exactly two primary arcing contacts and at least one primary moved contact are present; and the primary moved contacts and the primary arcing contacts are so arranged in stacked manner that the primary moved contacts are arranged between the primary arcing contacts.

According to one or more embodiments of the invention, the proposed switch comprises at least one secondary sacrificial contact or secondary arcing contact, which is mounted to be so pivotable relative to the diverter contact and the secondary fixed contact about the pivot axis that it can adopt a first end position in which it bears by a seventh contacting point or resting point or contact point against the diverter contact and by an eighth contacting point or resting point or contact point against the secondary fixed contact and can adopt a second end position in which it is separated from these contacts; wherein the secondary moved contacts and the secondary arcing contacts can be so pivoted in common that at least one of the secondary arcing contacts adopts the first end position before the secondary moved contacts and leaves after the secondary moved contacts.

The embodiments relating to the primary arcing contact also apply analogously to the secondary arcing contact, which is also termed secondary sacrificial contact.

According to one or more embodiments of the invention, exactly one secondary arcing contact and at least two secondary moved contacts are present; and the secondary moved contacts and the secondary arcing contact are so arranged in stacked manner that the number of secondary moved contacts on one side of the secondary arcing contact is higher by at most one than the number of secondary moved contacts on the opposite side of the secondary arcing contact.

According to one or more embodiments of the invention, exactly two secondary arcing contacts and at least one secondary moved contact are present; and the secondary moved contacts and the secondary arcing contacts are so arranged in stacked manner that the secondary moved contacts are arranged between the secondary arcing contacts.

According to one or more embodiments of the invention, each arcing contact in the second end position is so arranged relative to the associated moved contacts that its contact points project relative to the contact points of these moved contacts.

According to one or more embodiments of the invention, the arcing contacts are electrically conductively connected with the moved contacts.

According to one or more embodiments of the invention, the proposed switch comprises a contact carrier on which moved the contacts and/or the arcing contacts are mounted and which is mounted to be pivotable relative to the diverter contact and the fixed contacts about the pivot axis.

According to one or more embodiments of the invention, the contact carrier comprises a first carrier plate which is pivotable or mounted to be pivotable about the pivot axis; and the moved contacts and/or the arcing contacts are installed, in particular mounted, on the first carrier plate.

The first carrier plate preferably extends at right angles to the pivot axis and/or parallel to the first connecting straight line.

According to one or more embodiments of the invention, the contact carrier comprises a second carrier plate pivotable or mounted to be pivotable about the pivot axis; and the moved contacts and/or the arcing contacts are installed, in particular mounted, on the second carrier plate.

The second carrier plate is preferably installed on, in particular secured to, the first carrier plate.

The second carrier plate preferably extends at right angles to the pivot axis and/or parallel to the second connecting straight line.

According to one or more embodiments of the invention, the carrier plates are parallel; and the moved contacts and/or the arcing contacts are arranged between the carrier plates.

According to one or more embodiments of the invention, each moved contact and/or each arcing contact is or are so installed on the contact carrier that it is or they are resiliently biased in the first end position against the diverter contact and the associated fixed contact.

According to one or more embodiments of the invention, the pivot axis is arranged parallel and, in particular, at a spacing from a switching shaft for driving the switch, this being, in particular, part of the switching device.

According to one or more embodiments of the invention, the pivot axis lies closer to the first and second counterpoints than to the switching shaft or the spacings of the pivot axis from the first and second counterpoints are smaller than the spacing of the pivot axis from the switching shaft.

According to one or more embodiments of the invention, the pivot axis is arranged symmetrically between the switching shaft and the diverter contact.

Embodiments according to a second aspect of the invention provide a load changeover switch for or in an on-load tap changer of a setting transformer, comprising a continuous main switch which is constructed in accordance with the first, third or fourth aspect and/or an isolating switch which is constructed in accordance with the first, third or fourth aspect; a primary main line joined, in particular attached, to each primary fixed contact; and a secondary main line joined, in particular attached, to each secondary fixed contact.

The proposed load changeover switch preferably comprises a diverter line which is joined, in particular attached, to each diverter contact. The diverter line is preferably joined, in particular attached, to ground or to earth potential or to a star point or to a corner point of a delta connection or to a common diverter line terminal of the on-load tap changer. The diverter line terminal can in turn be joined, in particular attached, to ground or to earth potential or to a star point or to a corner point of a delta connection.

The primary main line is preferably joined, in particular attached, to a primary selector contact of the on-load tap changer and/or the secondary main line is preferably joined, in particular attached, to a secondary selector contact of the on-load tap changer.

According to one or more embodiments of the invention, the proposed load changeover switch comprises the continuous main switch; a primary main vacuum interrupter with a first and a second primary main terminal; and a secondary main vacuum interrupter with a first and a second secondary main terminal; wherein the first primary main terminal is electrically conductively connected with the primary fixed contact of the continuous main switch and/or can be electrically conductively connected with the primary selector contact; the first secondary main terminal is electrically conductively connected with the secondary fixed contact of the continuous main switch and/or can be electrically conductively connected with the secondary selector contact; and the second primary main terminal and the second secondary main terminal are electrically conductively connected with the diverter contact of the continuous main switch and/or the diverter line and/or can be electrically conductively connected with the diverter terminal.

According to one or more embodiments of the invention, the proposed load changeover switch comprises the isolating switch; a primary main vacuum interrupter with a first and second primary main terminal; and a secondary main vacuum interrupter with a first and second secondary main terminal; wherein the first primary main terminal is electrically conductively connected with the primary fixed contact of the continuous main switch and/or can be electrically conductively connected with the primary selector contact; the first secondary main terminal is electrically conductively connected with the secondary fixed contact of the continuous main switch and/or can be electrically conductively connected with the secondary selector contact; the primary fixed contact of the isolating switch is electrically conductively connected with the second primary main terminal; the secondary fixed contact of the isolating switch is electrically conductively connected with the second secondary main terminal; and the diverter contact of the isolating switch is electrically conductively connected with the diverter line and/or can be electrically conductively connected with the diverter terminal.

According to one or more embodiments of the invention, the proposed load changeover switch comprises the continuous main switch; a primary auxiliary vacuum interrupter with a first and second primary auxiliary terminal; and a secondary auxiliary vacuum interrupter with a first and second secondary auxiliary terminal; wherein the first primary auxiliary terminal is electrically conductively connected with the primary fixed contact of the continuous main switch and/or with the first primary main terminal and/or can be electrically conductively connected with the primary selector contact; the first secondary auxiliary terminal is electrically conductively connected with the secondary fixed contact of the continuous main switch and/or the first secondary main terminal and/or can be electrically conductively connected with the secondary selector contact; the second primary auxiliary terminal is electrically conductively connected with the second primary main terminal; and the second secondary auxiliary terminal is electrically conductively connected with the second secondary main terminal.

According to one or more embodiments of the invention, the proposed load changeover switch comprises the isolating switch; a primary auxiliary vacuum interrupter with a first and second primary auxiliary terminal; and a secondary auxiliary vacuum interrupter with a first and second secondary auxiliary terminal; wherein the first primary auxiliary terminal is electrically conductively connected with the primary fixed contact of the continuous main switch and/or with the first primary main terminal and/or can be electrically conductively connected with the primary selector contact; the first secondary auxiliary terminal is electrically conductively connected with the secondary fixed contact of the continuous main switch and/or with the first secondary main terminal and/or can be electrically conductively connected with the secondary selector contact; the primary fixed contact of the isolating switch is electrically conductively connected with the second primary auxiliary terminal; the secondary fixed contact of the isolating switch is electrically conductively connected with the second secondary auxiliary terminal; and the diverter contact of the isolating switch is electrically conductively connected with the diverter line and/or can be electrically connectively connected with the diverter terminal.

The proposed load changeover switch can be constructed in desired mode and manner according to requirements and, for example, comprise at least one additional continuous main switch and/or at least one additional isolating switch and/or at least one additional diverter line and/or at least one additional primary main line and/or at least one additional secondary main line and/or at least one additional primary main vacuum interrupter and/or at least one additional secondary main vacuum interrupter and/or at least one additional primary isolating switch and/or at least one additional secondary isolating switch and/or at least one additional primary auxiliary vacuum interrupter and/or at least one additional secondary auxiliary vacuum interrupter.

Embodiments according to a third aspect the invention provide a switch for or in a switching device, comprising a diverter contact; a fixed contact; at least two moved contacts, each of which is so movable relative to the diverter contact and/or the fixed contact that it can adopt a first end position in which it is electrically conductively connected with the diverter contact and the fixed contact and a second end position in which it is separated from the fixed contact and/or the diverter contact; an arcing contact which is so movable relative to the diverter contact and/or the fixed contact that it can adopt a first end position in which it is electrically conductively connected with the diverter contact and the fixed contact and a second end position in which it is separated from the fixed contact and/or the diverter contact; wherein the moved contacts and the arcing contact can be so moved in common that the arcing contact adopts the first end position before the moved contacts and leaves after the moved contacts; and the moved contacts and the arcing contact are so arranged in stacked manner that the number of moved contacts on one side of the arcing contact is higher by at most one than the number of the moved contacts on the opposite side of the arcing contact.

Embodiments according to a fourth aspect the invention provide a switch for or in a switching device, comprising a diverter contact; a fixed contact; at least one moved contact, each of which is so movable relative to the diverter contact and/or the fixed contact that it can adopt a first end position in which it is electrically conductively connected with the diverter contact and the fixed contact and a second end position in which it is separated from the fixed contact and/or the diverter contact; and two arcing contacts, each of which is so movable relative to the diverter contact and/or the fixed contact that it can adopt a first end position in which it is electrically conductively connected with the diverter contact and the fixed contact and a second end position in which it is separated from the fixed contact and/or the diverter contact; wherein the moved contacts and the arcing contacts can be so moved in common that at least one of the arcing contacts adopts the first end position before the moved contacts and leaves after the moved contacts; and the moved contacts and the arcing contacts are so arranged in stacked manner that the moved contacts are arranged between the arcing contacts.

In the case of a switch provided according to the third or fourth aspect, each moved contact and/or each arcing contact in the first end position can bear against the diverter contact and in the second end position is or are separated from the diverter contact; and/or each moved contact and/or each arcing contact in the first end position bears or bear against the fixed contact and in the second end position is or are separated from the fixed contact.

This electrically conductive connection is preferably improved and ensured in the first end position in that the respective moved contact or arcing contact is pressed against the corresponding diverter contact or fixed contact.

In the case of a switch provided according to the third or fourth aspect, each moved contact and/or each arcing contact can be non-separably and/or permanently electrically conductively connected with the diverter contact or the fixed contact.

This non-separable and/or permanent electrically conductive connection is preferably produced by way of a wiping connection or by means of a flexible line which, in particular, is secured integrally with or by soldering to or by screw-connection with the respective contacts.

A switch provided according to the third or fourth aspect can be constructed in any desired mode and manner according to requirements and can, for example, comprise at least one additional diverter contact and/or at least one additional fixed contact and/or at least one additional arcing contact.

A switch provided according to the third or fourth aspect can preferably be constructed like a switch provided according to the first aspect.

The outlines and explanations with respect to one of the aspects of the invention, particularly to individual features of this aspect, also correspondingly apply in analogous manner to the other aspects of the invention.

Figure 2:
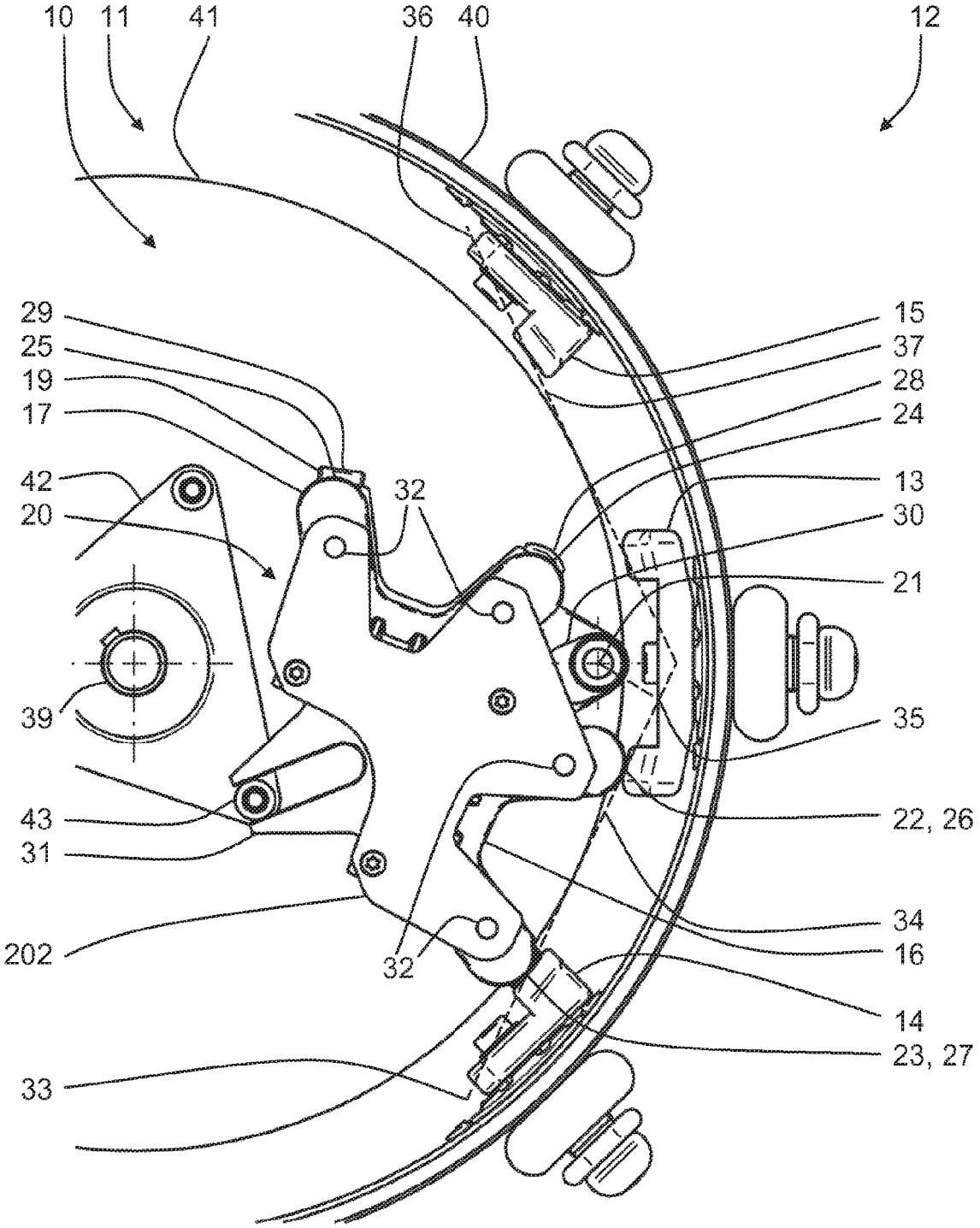
FIG. 2 shows a plan view of a load changeover switch, which comprises the continuous main switch of FIG. 1, in a first operating setting, and an on-load tap changer according to an embodiment of the invention.
Figure 3:
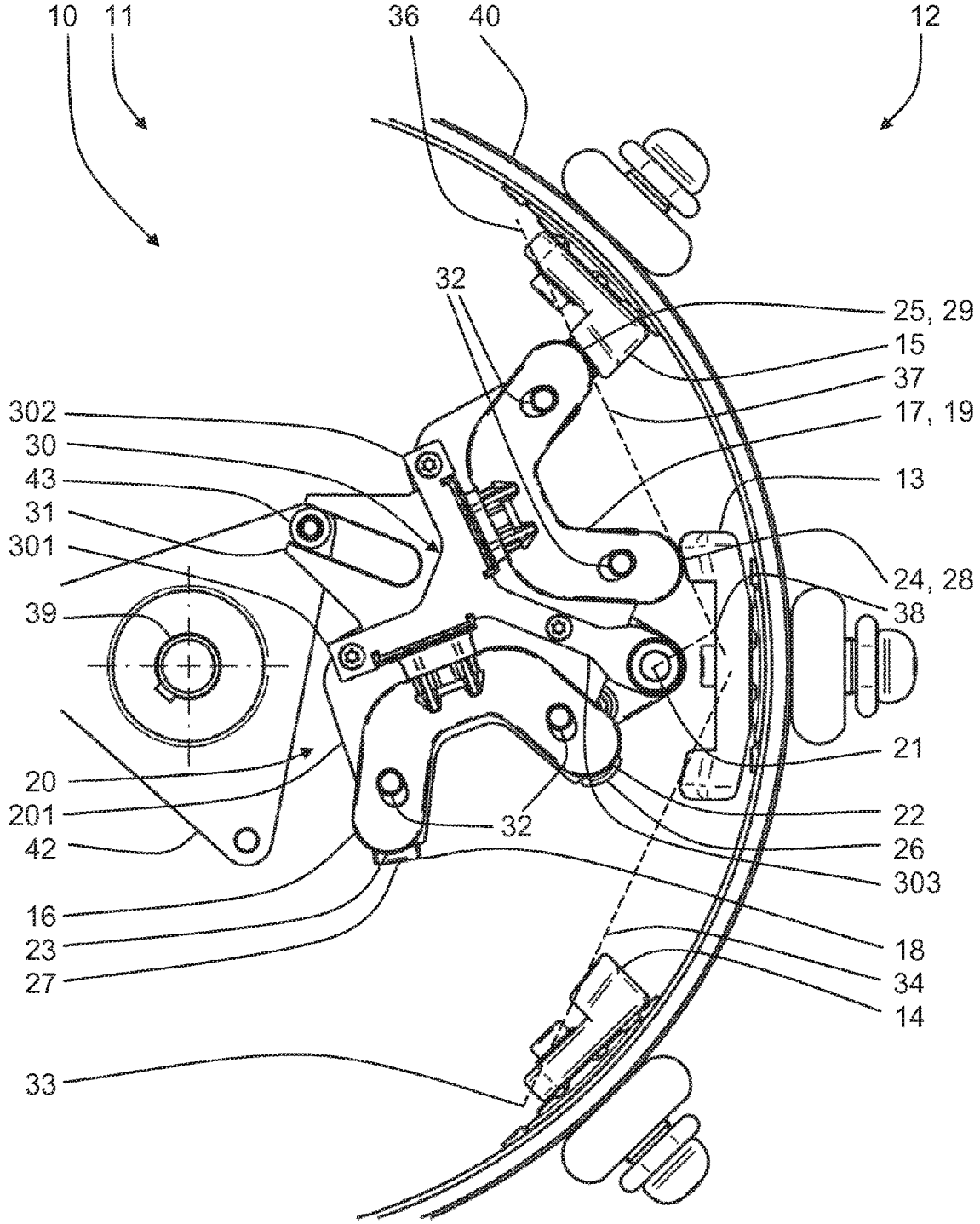
FIG. 3 shows the load changeover switch of FIG. 2 in a second operating setting.

A switch 10 for a switching device 11, which here by way of example is a continuous mains switch 10 for a load changeover switch 11 (FIGS. 2 to 4) of an on-load tap changer 12 (FIG. 5), but by way of example can also be an isolating switch for the load changeover switch 11, is schematically illustrated in FIGS. 1, 2 and 3.

The switch 10 comprises a diverter 13, a primary fixed contact 14, a secondary fixed contact 15, twelve primary moved contacts 16, twelve secondary moved contacts 17, a primary arcing contact 18, a secondary arcing contact 19 and a contact carrier 20 with a first carrier plate 201 and a second carrier plate 202 (not illustrated in FIG. 3).

Each primary moved contact 16 is mounted to be so pivotable relative to the diverter contact 13 and the primary fixed contact 14 about a pivot axis 21 that it can adopt a first end position, which is illustrated in FIG. 2, and a second end position, which is illustrated in FIGS. 1, 3. In the first end position it lies by a first contact point 22 against a first counterpoint of the diverter contact 13 and by a second contact point 23 against the primary fixed contact 14 and in the second end position it is separated from these contacts 13, 14. Each secondary moved contact 17 is mounted to be so pivotable relative to the diverter contact 13 and the secondary fixed contact 15 about the pivot axis 21 that it can adopt a first end position, which is illustrated in FIGS. 1, 3, and a second end position, which is illustrated in FIG. 2. In the first end position it lies by a third contact point 24 against a second counterpoint of the diverter contact 13 and by a fourth contact point 25 against the secondary fixed contact 15 and in the second end position it is separated from these contacts 13, 15. The first counterpoint is arranged at a spacing from the second counterpoint and the pivot axis 21 is arranged symmetrically between these counterpoints.

The primary arcing contact 18 is mounted to be so pivotable relative to the diverter contact 13 and the primary fixed contact 14 about the pivot axis 21 that it can adopt a first end position in which it bears by a fifth contact point 26 against the diverter contact 13 and by a sixth contact point 27 against the primary fixed contact 14 and a second end position in which is separated from these contacts 13, 14. The secondary arcing contact 19 is mounted to be so pivotable relative to the diverter contact 13 and the secondary fixed contact 15 about the pivot axis 21 that it can adopt a first end position in which it bears by a seventh contact point 28 against the diverter contact 13 and by an eighth contact point 29 against the secondary fixed contact 15 and a second end position in which it is separated from these contacts 13, 15. The first contact point 22 is arranged at a spacing from the third contact point 24 and the pivot axis 21 is arranged symmetrically between these contact points 22, 24.

The primary moved contacts 16 and the primary arcing contact 18 are stacked in such a manner to form a primary contact stack 16/18 that in each instance six primary moved contacts 16 lie below and above the primary arcing contact 18. The secondary moved contacts 17 and the secondary arcing contact 19 are stacked in such a manner to form a secondary contact stack 17/19 that in each instance six secondary moved contacts 17 lie below and above the secondary arcing contact 19. The moved contacts 16, 17 are constructionally identical to one another. The arcing contacts 18, 19 are constructionally identical to one another.

The contact carrier 20 comprises a lever 30 (FIG. 3) with three arms 301, 302, 303, which are arranged in Y shape, and a fork 31. The carrier plates 201, 202 are constructionally identical and arranged in parallel and in alignment one above the other and consist of metal. The lever 30 is arranged between the carrier plates 201, 202 and secured thereto by three bolts which pass through the free ends of the two lateral arms 301, 302 and a central section of the middle arm 303. The fork 31 is secured to the lever 30 between the two lateral arms 301, 302 on the side facing away from the middle arm 303 and has a slot which extends in prolongation of the middle arm 303 and is open at its outer end remote from the lever 30. The contact stacks 16/18, 17/19 are arranged between the carrier plates 201, 202 and are movably mounted thereon by two times two guide pins 32, which pass through parallel slots in the contact stacks 16/18, 17/19 and consist of metal. The free end of the middle arm 303 is mounted to be pivotable about the pivot axis 21. The carrier plates 201, 202 and consequently also the contact carrier 20, the fork 31 and the contact stacks 16/18, 17/19 are thus mounted to be pivotable relative to the diverter contact 13 and the fixed contacts 14, 15 about the pivot axis 21. The contact stacks 16/18, 17/19 and the contact carrier 20 thus form a single-arm lever with respect to the pivot axis 21.

Figure 4:
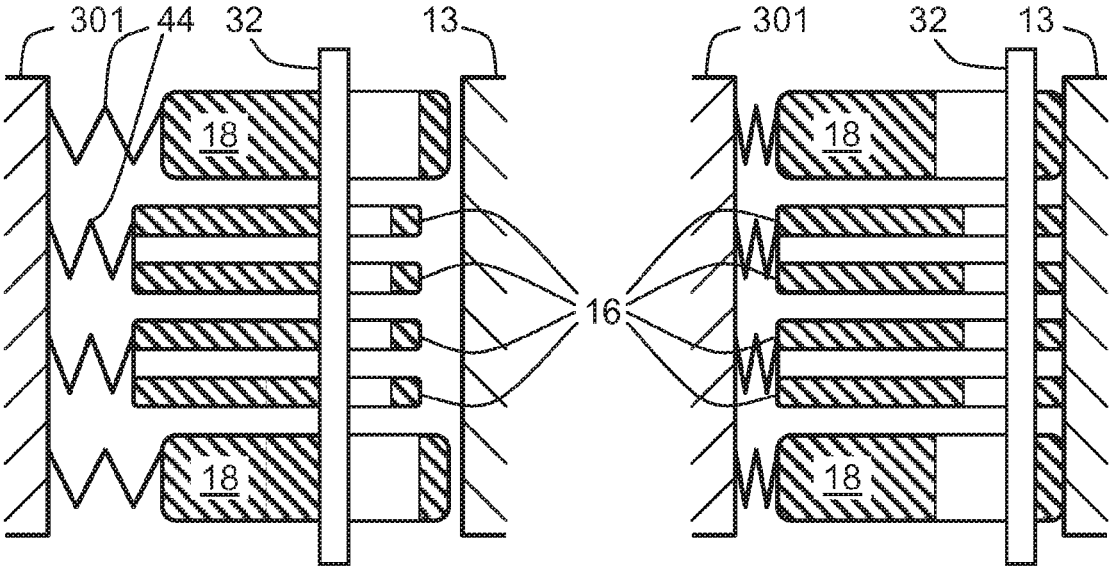
FIG. 4 shows a sectional part view of a continuous main switch according to an embodiment of the invention.

The contact stacks 16/18, 17/19 are arranged symmetrically with respect to the lever 30 on either side of the middle arm 303 and are supported by their back surfaces, which face away from the contact points, on the lateral arms 301, 302 by way of compression springs (FIG. 4). The contact stacks 16/18, 17/19 are thereby mounted on the contact carrier 20 in such a way that in the first end position thereof they are respectively biased resiliently against the diverter contact 13 and the associated fixed contact 14, 15.

Each arcing contact 18; 19 and the respectively associated moved contacts 16; 17 are so constructed and arranged and can be so pivoted in common that the respective arcing contact 18; 19 adopts the first end position before its moved contacts 16; 17 and leaves after them. For that purpose, the respective arcing contact 18; 19 is so arranged in the second end position relative to its moved contacts 16; 17 that its contact points 26, 27; 28, 29 project relative to the contact points 22, 23; 24, 25 of these moved contacts 16; 17.

The diverter contact 13, fixed contacts 14, 15 and moved contacts 16, 17 consist of copper. In this form of embodiment the primary arcing contact 18 consists of a WCu alloy in a first contact region, which contains or surrounds the fifth contact point 26, and in a second contact region, which contains or surrounds the sixth contact point 27, and otherwise consists of copper. Consequently, in these contact regions it is more erosion-resistant and arc-resistant than in its remaining region and than the corresponding contact regions of the primary moved contacts 16. In this form of embodiment the secondary arcing contact 19 consists of a WCu alloy in a third contact region, which contains or surrounds the seventh contact point 28, and in a fourth contact region, which contains or surrounds the eighth contact point 29, and otherwise consists of copper. Consequently, it is more erosion-resistant and arc-resistant in these contact regions than in its remaining region and than the corresponding contact regions of the secondary moved contacts 17.

The contacts 13, 14, 15, 16, 17, 18, 19 are each monolithic. The diverter contact 13 and the pivot axis 21 are arranged symmetrically between the fixed contacts 14, 15.

At each primary fixed contact 14, the first and second contact points 22, 23 lie, in the first end position, on a first connecting straight line 33, which is at right angles and skewed with respect to the pivot axis 21, and delimit a first connecting path 34. The dropped perpendicular foot 35 of the first connecting straight line 33, thus the end point—which lies on the first connecting straight line 33—of the vertical between the pivot axis 21 and the first connecting straight line 33, lies outside or within the first connecting path 34. At each secondary fixed contact 15 the third and the fourth contact points 24, 25 lie, in the first end position, on a second connecting straight line 36, which is at right angles and skewed with respect to the pivot axis 21, and delimit a second connecting path 37. The dropped perpendicular foot 38 of the second connecting straight line 36, thus the end point—which lies on the second connecting straight line 36—of the vertical between the pivot axis 21 and the second connecting straight line 36, lies outside or within the second connecting path 37.

In addition, a load changeover switch 11 and an on-load tap changer 12 are schematically illustrated in FIGS. 2 and 3.

The on-load tap changer 12 comprises the load changeover switch 11, a switching shaft 39 for driving the continuous main switch 10 and a contact cylinder 40, through which the switching shaft 39 coaxially extends. The diverter contact 13 and the fixed contacts 14, 15 are led through the contact cylinder 40 and secured thereto. The pivot axis 21 is arranged parallel to the switching shaft 39 symmetrically between the switching shaft 39 and the diverter contact 13 and lies closer to the first and second counterpoints than to the switching shaft 39. The switching shaft 39, the pivot axis 21 and the centre between the counterpoints lie on a straight line.

The load changeover switch 11 comprises a base plate 41 (not illustrated in FIGS. 3, 5), a framework, which is not illustrated in more detail, a triangular driver 42 and an entraining roller 43. The switching shaft 39 and the lever 30 are rotatably mounted on the base plate 41. The driver 42 is seated on the switching shaft 39 to be secure against relative rotation and carries the entraining roller 43 at a corner. The entraining roller 43 is displaceably seated in the slot of the fork 31 so that rotation of the switching shaft 39 pivots, by way of the driver 42, the entraining roller 43 and the fork 31, the lever 30 in opposite sense about the pivot axis 21 and this pivot movement is transmitted by way of the three bolts, the carrier plates 201, 202 and the four guide pins 32 to the contact stacks 16/18, 17/19.

In FIG. 2 the load changeover switch 11 is shown in a first operating setting in which the entraining roller 43 is seated at the outer end of the slot of the fork 31 and the primary contact stack 16/18 adopts its first end position and the secondary contact stack 17/19 its second end position. The entraining roller 43 presses against the slot wall near the primary fixed contact 14 and thus presses the primary contact stack 16/18 by way of the two guide pins 32 associated therewith against the diverter contact 13 and the primary fixed contact 14. The secondary contact stack 17/19 separated from the diverter contact 13 and the secondary fixed contact 15 is pressed by the compression springs associated therewith against the two guide pins 32 associated therewith. The moved contacts 16/17 are thus electrically conductively connected with one another and with the arcing contacts 18, 19.

In FIG. 3 the load changeover switch 11 is shown in a second operating setting in which the entraining roller 43—as in the case of the first operating setting—is seated at the outer end of the slot of the fork 31 and the secondary contact stack 17/19 adopts its first end position and the primary contact stack 16/18 its second end position. The entraining roller 43 presses—in distinction from the first operating setting—against the slot wall near the secondary fixed contact 15 and thus presses the second contact stack 17/19 by way of the two guide pins 32 associated therewith against the diverter contact 13 and the secondary fixed contact 15. The primary contact stack 16/18 separated from the diverter contact 13 and the primary fixed contact 14 is pressed by the compression springs (FIG. 4) associated therewith against the two guide pins 32 associated therewith. The moved contacts 16, 17 are thus electrically conductively connected with one another and with the arcing contacts 18, 19.

If the load changeover switch 11 is brought by rotation of the switching shaft 39 in counter-clockwise sense from the first to the second operating setting then the second contact point 23 and the sixth contact point 27 detach more rapidly from the primary fixed contact 14 than the fifth contact point 26 detaches from the diverter contact 13, since they are radially more distant from the pivot axis 21 than the fifth contact point 26. It is analogous on the other side: if the load changeover switch 11 is brought by rotation of the switching shaft 39 in clockwise sense from the second to the first operating setting then the fourth contact point 25 and the eighth contact point 29 detach more rapidly from the secondary fixed contact 15 than the seventh contact point 28 detaches from the diverter contact 13, since they are radially more distance from the pivot axis 21 than the seventh contact point 28. Consequently, arcs form primarily at the sixth and eighth contact points 27, 29 as well as at the respective second and fourth contact region surrounding them, so that in an alternative form of embodiment it is possible to dispense with the CuW alloy at the first and third contact regions and/or the projection of the fifth and seventh contact points 26, 28.

A second embodiment of the continuous main switch 10 is schematically illustrated in a part detail in FIG. 4. However, by way of example this continuous main switch 10 can also form an isolating switch for the load changeover switch 11. This second embodiment is similar to the first embodiment, so that in the following primarily the differences are explained in more detail.

In this second embodiment the continuous main switch 10 comprises in the primary contact stack 16/18 two primary arcing contacts 18 and four primary moved contacts 16, which are so arranged in stacked form that the primary moved contacts 16 are disposed between the primary arcing contacts 18. The figure shows on the left the primary contact stack 16/18 shortly before reaching or shortly after leaving the second end position and on the right in the second end position. The compression springs 44 between the back surfaces of the primary contact stack 16/18 or the back surfaces of the primary moved contacts 16 and the primary arcing contacts 18 and the lateral arm 301 are also illustrated. The secondary contact stack 17/19 is of analogous construction, but not illustrated in FIG. 4.

Figure 5:
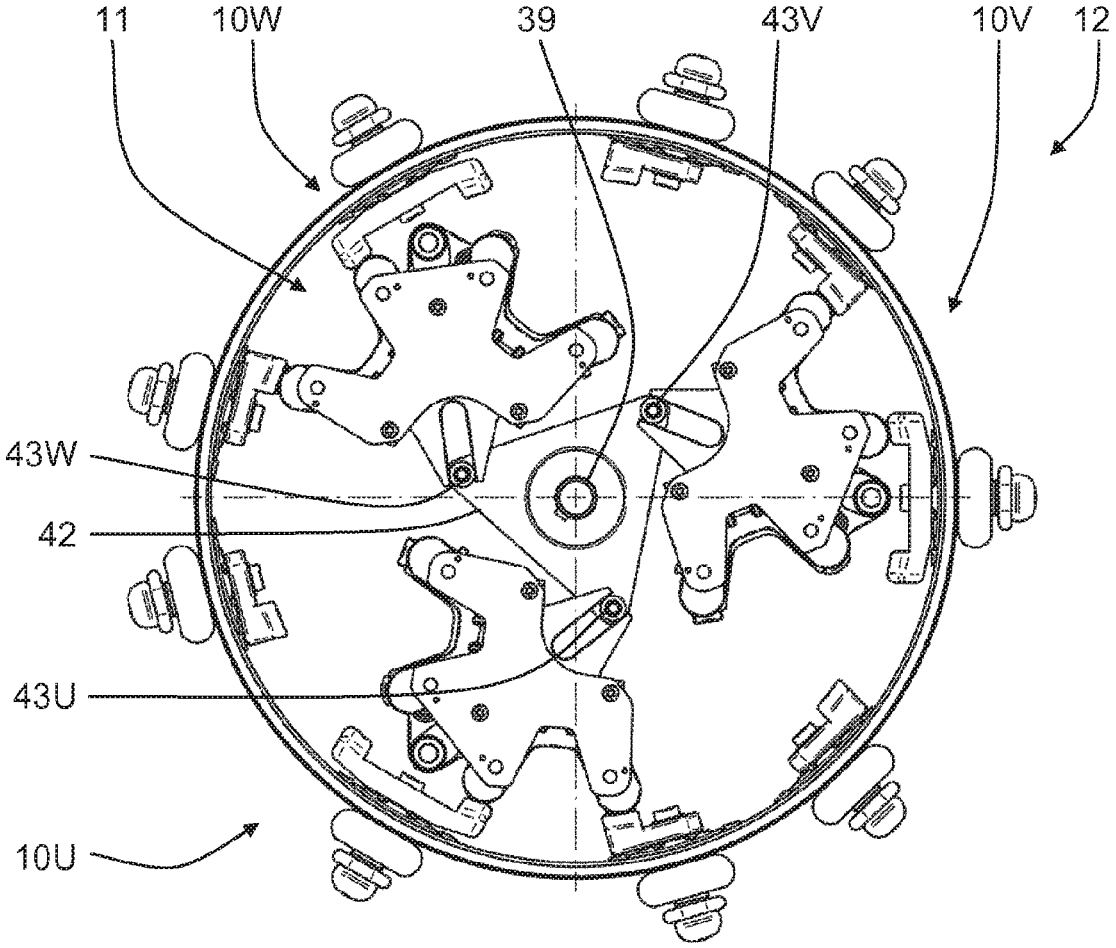
FIG. 5 shows a plan view of a load changeover switch according to an embodiment of the invention and an on-load tap changer according to an embodiment of the invention.

A second embodiment of the load changeover switch 11 and a second embodiment of the on-load tap changer 12 are schematically illustrated in FIG. 5. These second embodiments are similar to the corresponding first embodiments, so that in the following primarily the differences are explained in more detail.

In the second embodiments the load changeover switch 11 and the on-load tap changer 12 are of three-phase configuration. The load changeover switch 11 comprises, for each phase U, V, W of a three-phase alternating current mains, a respective entraining roller 43U, 43V, 43W, which rollers are arranged at the corners of the driver 42, and a respective continuous main switch 10U, 10V, 10W. The three entraining rollers 43 and the three continuous main switches 10 are arranged around the switching shaft 39 to be offset by 120° and are actuated synchronously by rotation of the switching shaft 39.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

10 switch, continuous main switch, isolating switch
11 switching device, load changeover switch
12 on-load tap changer
13 diverter contact
14 primary fixed contact
15 secondary fixed contact
16 primary moved contact
17 secondary moved contact
18 primary arcing contact
19 secondary arcing contact
20 contact carrier
201/202 first/second carrier plate of 20

21 pivot axis
22 first contact point
23 second contact point
24 third contact point
25 fourth contact point
26 fifth contact point
27 sixth contact point
28 seventh contact point
29 eighth contact point
30 lever
301/302/303 first lateral/second lateral/middle arm of 30
31 fork
32 guide pin
33 first connecting straight line
34 first connecting path
35 first dropped perpendicular foot
36 second connecting straight line
37 second connecting path
38 second dropped perpendicular foot
39 switching shaft
40 contact cylinder
41 base plate
42 driver
43 entraining rollers
44 compression springs
U, V, W phases of a three-phase alternating current mains

The invention claimed is:

1. A switch, comprising
a diverter contact;
a primary fixed contact;
a secondary fixed contact;
a primary movable contact configured to be pivoted, relative to the diverter contact and the primary fixed contact, about a pivot axis between a first end position and a second end position, wherein in the first end position the primary movable contact bears by a first contact point against the diverter contact and by a second contact point against the primary fixed contact, and wherein in the second end position the primary movable contact is separated from the diverter contact and the primary fixed contact; and
a secondary movable contact configured to be pivoted, relative to the diverter contact and the secondary fixed contact, about the pivot axis between a first end position and a second end position, wherein in the first end position the secondary movable contact bears by a third contact point against the diverter contact and by a fourth contact point against the secondary fixed contact, and wherein in the second end position the secondary movable contact is separated from the diverter contact and the secondary fixed contact.

2. The switch according to claim 1, wherein a first counterpoint at which the first contact point bears against the diverter contact is spaced apart from a second counterpoint at which the third contact point bears against the diverter contact; and
wherein the pivot axis is arranged symmetrically between the first and second counterpoints.

3. The switch according to claim 1, wherein
the diverter contact is monolithic;
the primary fixed contact is monolithic;
the secondary fixed contact is monolithic;
the primary movable contact is monolithic; and
the secondary movable contact is monolithic.

4. The switch according to claim 1, wherein in the first end position, the first and second contact points lie on a first connecting straight line that at least one of non-parallel, at right angles, or skewed with respect to the pivot axis.

5. The switch according to claim 1, wherein in the first end position the first and second contact points lie on a first connecting straight line and delimit a first connecting path; and
wherein the first connecting straight line and the pivot axis intersect and the point of intersection thereof lies outside or within the first connecting path or the first connecting straight line and the pivot axis are skewed and the dropped perpendicular foot of the first connecting straight line lies outside or within the first connecting path.

6. The switch according to claim 1, wherein the diverter contact and the pivot axis are arranged symmetrically between the fixed contacts.

7. The switch according to claim 1, further comprising:
an additional primary movable contact configured to be pivoted, relative to the diverter contact and the primary fixed contact about the pivot axis, between a first position and a second end position, wherein the additional primary movable contact bears against the diverter contact and the primary fixed contact in the first position, and wherein the additional primary movable contact is separated from the diverter contact and the secondary fixed contact in the second end position; and/or
an additional secondary movable contact configured to be pivoted, relative to the diverter contact and the secondary fixed contact about the pivot axis, between a first end position and a second end position, wherein the additional secondary movable contact bears against the diverter contact and the secondary fixed contact in the first end position, and wherein the additional secondary movable contact is separated from the diverter contact and the secondary fixed contact in the second end position.

8. The switch according to claim 1, further comprising:
a primary arcing contact configured to be pivoted, relative to the diverter contact and the primary fixed contact, about the pivot axis between a first end position and a second end position, wherein the primary arcing contact bears by a fifth contact point against the diverter contact and by a sixth contact point against the primary fixed contact in the first end position, and wherein the primary arcing contact is separated from the diverter contact and the primary fixed contact in the second end position;
wherein the primary movable contact and the primary arcing contact can be so pivoted in common such that the primary arcing contact adopts the first end position before the primary movable contact and leaves after the primary movable contacts.

9. The switch according to claim 1, wherein exactly one primary arcing contact and at least two primary movable contacts are present; and
wherein the at least two primary movable contacts and the primary arcing contact are arranged in a stack such that a number of primary movable contacts on one side of the primary arcing contact is greater by at most one than a number of primary movable contacts on an opposite side of the primary arcing contact.

10. The switch according to claim 1, wherein exactly two primary arcing contacts and at least one primary movable contact are present; and
wherein the at least one primary movable contact and the exactly two primary arcing contacts are arranged in a stack such that the at least one primary movable contact is arranged between the exactly two primary arcing contacts.

11. The switch according to claim 10, wherein each arcing contact in the second end position is so arranged relative to an associated moved contacts that its contact points project relative to the contact points of these moved contacts.

12. The switch according to claim 1, further comprising:

a contact carrier, including a first carrier plate and a second carrier plate mounted to be pivotable about the pivot axis and arranged parallel to the first carrier plate;

wherein the primary movable contact and the secondary movable contact and/or arcing contacts are mounted on the carrier plates and arranged between the carrier plates.

13. The switch according to claim 12, wherein each movable contact and/or each arcing contact is/are mounted on the contact carrier such that in the first end position each movable contact and/or each arching contact is/are resiliently biased against the diverter contact and an associated fixed contact.

14. The switch according to claim 1, wherein the pivot axis is arranged parallel to a switching shaft for driving the switch.

15. The switch according to claim 14, wherein the pivot axis lies closer to first and second counterpoints than to the switching shaft.

16. The switch according to claim 14, wherein the pivot axis is arranged symmetrically between the switching shaft and the diverter contact.

17. The switch according to claim 1, the switch being constructed as a continuous mains switch or as an isolating switch for or in a load changeover switch of an on-load tap changer.

18. A load changeover switch for or in an on-load tap changer of a setting transformer, comprising the switch according to claim 1;

a primary main line joined to the primary fixed contact; and a secondary main line joined to the secondary fixed contact.

* * * * *